US007473046B2

(12) United States Patent
Kraus et al.

(10) Patent No.: US 7,473,046 B2
(45) Date of Patent: Jan. 6, 2009

(54) CLEANING UTENSIL FOR A FLUID CONTAINER

(75) Inventors: Stephanie Kraus, Glendale, CA (US); Randal Ouye, La Crescenta, CA (US)

(73) Assignee: Disney Enterprises, Inc., Burbank, CA (US)

( * ) Notice: Subject to any disclaimer, the term of this patent is extended or adjusted under 35 U.S.C. 154(b) by 549 days.

(21) Appl. No.: 11/091,968

(22) Filed: Mar. 28, 2005

(65) Prior Publication Data

US 2006/0216102 A1 Sep. 28, 2006

(51) Int. Cl.

| | |
|---|---|
| ***A46B 15/00*** | (2006.01) |
| ***A46B 11/04*** | (2006.01) |
| ***A47L 1/08*** | (2006.01) |
| ***A47L 13/12*** | (2006.01) |
| *B43M 11/06* | (2006.01) |

(52) U.S. Cl. ..... 401/117; 401/9; 401/24; 401/183; 401/29; 401/270; 15/164; 15/114

(58) Field of Classification Search ..... 401/9, 401/11, 16, 23, 24, 19, 99, 117, 290, 272, 401/183, 29, 270; 15/114, 106, 164, 211
See application file for complete search history.

(56) References Cited

U.S. PATENT DOCUMENTS

| | | | | |
|---|---|---|---|---|
| 4,714,174 | A | | 12/1987 | Williams |
| 4,795,052 | A | | 1/1989 | Hayes, Jr. |
| 4,801,027 | A | | 1/1989 | Hunter |
| 4,915,250 | A | | 4/1990 | Hayes, Jr. |
| 4,953,737 | A | | 9/1990 | Meyers |
| 5,050,759 | A | | 9/1991 | Marble |
| 5,294,018 | A | | 3/1994 | Boucher |
| D371,779 | S | | 7/1996 | Nowak et al. |
| D376,734 | S | | 12/1996 | Petrie |
| D379,495 | S | | 5/1997 | Sidman et al. |
| D383,911 | S | | 9/1997 | Conforti et al. |
| 5,669,665 | A | | 9/1997 | Nowak |
| D386,104 | S | | 11/1997 | Nowak |
| D386,703 | S | | 11/1997 | Nowak |
| D387,239 | S | | 12/1997 | Johnstone |
| D389,359 | S | | 1/1998 | Nowak |
| 5,709,003 | A | * | 1/1998 | Batch ..... 15/106 |
| D390,135 | S | | 2/1998 | Rossman et al. |
| D391,407 | S | | 3/1998 | Rossman et al. |
| 5,725,117 | A | | 3/1998 | Berjis |
| D394,166 | S | | 5/1998 | Rossman et al. |
| 5,755,489 | A | | 5/1998 | Rossman et al. |

(Continued)

*Primary Examiner*—David J Walczak
(74) *Attorney, Agent, or Firm*—Greenberg Traurig, LLP

(57) ABSTRACT

A cleaning utensil for cleaning a container comprises a first cleaning unit and a second cleaning unit is axially movable relative to the mounting for the first unit. The second unit is for location axially within an axial aperture of the first unit. Each cleaning unit includes a brush with relatively outwardly extending bristles. The first cleaning unit includes a sponge which is relatively outwardly extending. There is a closable cavity in the handle for containing cleaning fluid, and the cavity is connected with the first cleaning unit or second cleaning unit. Cleaning fluid can be expelled from the container through one of the units to facilitate the cleaning of the bottle. The first cleaning unit effectively cleans a portion of an inside of a baby bottle, and the second cleaning unit effectively cleans a second portion of an inside of the baby bottle.

34 Claims, 3 Drawing Sheets

U.S. PATENT DOCUMENTS 5,761,756 A 6/1998 Nowak et al.
5,763,796 A 6/1998 Britto et al.
5,765,715 A 6/1998 Hughes
5,772,088 A 6/1998 Nelson
D395,832 S 7/1998 Rossman et al.
D396,292 S 7/1998 Nowak
D396,717 S 8/1998 Sidman et al.
5,833,189 A 11/1998 Rossman et al.
D403,842 S 1/1999 Bair et al.
5,871,118 A 2/1999 Franzese
5,890,620 A 4/1999 Belcastro
5,893,472 A 4/1999 Forrer
D411,349 S 6/1999 Johnstone
D412,292 S 7/1999 Nowak et al.
5,938,053 A 8/1999 Verbovszky et al.
D413,792 S 9/1999 Hotaling et al.
D417,275 S 11/1999 Conforti
5,984,555 A * 11/1999 Samad ..... 401/176
5,993,285 A 11/1999 Sofia et al.
5,993,478 A 11/1999 Nowak
D417,914 S 12/1999 Nowak
6,000,750 A 12/1999 Rossman et al.
D419,785 S 2/2000 Conforti et al.
D421,125 S 2/2000 Nowak
D421,126 S 2/2000 Nowak
6,026,528 A 2/2000 Pina
D421,469 S 3/2000 Reinke et al.
6,033,019 A 3/2000 Hession-Kunz et al.
6,037,872 A 3/2000 Dunnum
D422,849 S 4/2000 Knight et al.
6,045,254 A 4/2000 Inbar et al.
6,049,954 A 4/2000 Britto
D424,203 S 5/2000 Nowak
D424,312 S 5/2000 Hotaling et al.
D424,958 S 5/2000 Nowak
D426,300 S 6/2000 Conforti
6,089,653 A 7/2000 Hotaling et al.
D430,052 S 8/2000 Nowak
D430,737 S 9/2000 Nowak et al.
D432,342 S 10/2000 Popek et al.
RE37,016 E 1/2001 Morano
D436,655 S 1/2001 Hotaling et al.
D436,800 S 1/2001 Nowak et al.
6,168,034 B1 1/2001 Perrone
6,176,042 B1 1/2001 Rossman et al.
6,202,247 B1 * 3/2001 Lorenz, Jr. ..... 15/118
6,212,706 B1 4/2001 Rossman et al.
D443,233 S 6/2001 Gaudet et al.
6,253,392 B1 7/2001 Conforti et al.
6,269,968 B1 8/2001 Belcastro
6,322,149 B1 11/2001 Conforti et al.
6,325,236 B1 12/2001 Wong
6,349,443 B1 * 2/2002 Randolph et al. ..... 15/114
6,354,708 B1 3/2002 Monahan et al.
D460,322 S 7/2002 Orr et al.
6,412,527 B1 7/2002 Brice
6,415,460 B1 7/2002 Rossman et al.
D461,361 S 8/2002 Orr et al.
D465,423 S 11/2002 Larson et al.
6,478,435 B2 11/2002 Monahan et al.
D467,125 S 12/2002 Orr et al.
6,499,254 B2 12/2002 Rossman et al.
D469,860 S 2/2003 Riemer et al.
6,513,379 B2 2/2003 Meyers et al.
6,536,163 B1 3/2003 Monahan et al.
6,536,502 B2 3/2003 Britto et al.
6,571,981 B2 6/2003 Rohlfs
6,578,209 B2 6/2003 Lopes et al.
D478,669 S 8/2003 Wear
6,640,992 B1 11/2003 Berger et al.
6,648,396 B2 11/2003 Monahan et al.
6,658,678 B2 12/2003 Hotaling et al.
6,658,681 B2 12/2003 Britto et al.
6,673,036 B1 1/2004 Britto
6,692,072 B2 2/2004 Nelson et al.
6,695,678 B1 2/2004 Foley et al.
6,749,582 B2 6/2004 Britto et al.
6,802,757 B1 10/2004 Sejnowski
6,834,400 B2 12/2004 Zanardelli et al.
6,835,019 B2 * 12/2004 White ..... 401/197
6,840,918 B1 1/2005 Britto et al.
D502,551 S 3/2005 Hotaling et al.
6,910,594 B2 6/2005 Foley et al.
6,923,337 B2 8/2005 Hession et al.
6,928,674 B2 8/2005 Blackburn
6,954,955 B2 10/2005 Brewin et al.
6,964,572 B2 11/2005 Cesa
6,976,604 B2 12/2005 Connors, Jr. et al.
2004/0060577 A1 * 4/2004 Dunn ..... 134/8

* cited by examiner

CLEANING UTENSIL FOR A FLUID CONTAINER

RELATED APPLICATIONS

This application is related to U.S. Utility patent application filed on Mar. 28, 2005, entitled "MULTI-COMPARTMENT DISPENSING CONTAINER" Ser. No. 11/092,549; U.S. Utility patent application filed on Mar. 28, 2005, entitled "IRREGULAR SHAPED BABY BOTTLE" Ser. No. 11/092,361; U.S. Utility patent application filed on Mar. 28, 2005, entitled "A HANDLED DRINKING CONTAINER" Ser. No. 11/091,973; and U.S. Utility patent application filed on Mar. 28, 2005, entitled "BABY BOTTLE WITH ENLARGED LOWER PORTION" Ser. No. 11/091,971; all of which have been filed concurrently herewith. The contents of those applications are incorporated by reference herein.

RELATED APPLICATIONS

This application is related to U.S. Utility patent application filed on Mar. 28, 2005, entitled "MULTI-COMPARTMENT DISPENSING CONTAINER" Ser. No. 11/092,549; U.S. Utility patent application filed on Mar. 28, 2005, entitled "IRREGULAR SHAPED BABY BOTTLE" Ser. No. 11/092,361; U.S. Utility patent application filed on Mar. 28, 2005, entitled "A HANDLED DRINKING CONTAINER" Ser. No. 11/091,973; and U.S. Utility patent application filed on Mar. 28, 2005, entitled "BABY BOTTLE WITH ENLARGED LOWER PORTION" Ser. No. 11/091,971; all of which have been filed concurrently herewith. The contents of those applications are incorporated by reference herein.

BACKGROUND

1. Field

This disclosure pertains generally to the field of container cleaning. More specifically, this disclosure relates to an improved utensil for cleaning infant feeding equipment, such as bottles and cups, that is more hygienic, efficient and attractive than articles that are presently available for similar purposes.

2. General Background

Proper hygiene when handling and cleaning infant feeding equipment, such as baby bottles and nursing nipples, is important. Ideally, bottles and nipples should be thoroughly scrubbed, then sterilized by immersion in boiling water between uses. Proper scrubbing is especially important after a nipple or bottle has been used.

Bottle cleaning and scrubbing utensils are well known. None of the known devices have the features of effectively cleaning containers such as baby bottles as easily and efficiently as possible.

SUMMARY

The present disclosure recognizes and addresses disadvantages of prior art constructions, and it is an object of the present disclosure to provide an improved baby bottle.

Accordingly, it is an object of the present disclosure to provide an improved baby bottle cleaning utensil that is more efficient and hygienic than the bottle brushes that are presently available.

A cleaning utensil for cleaning a container comprises a first cleaning unit sized and configured so as to be able to effectively clean a portion of an inside of a container. There is a second cleaning unit sized and configured differently to the first cleaning unit, so as to be able to effectively clean a second portion of an inside of the container.

The first cleaning unit and second cleaning unit are relatively movable with respect to each other, and both cleaning units are attached to an elongated handle. The elongated handle is intended for gripping by the hand of a user such that the user can manipulate the cleaning units around the inside of the container during cleaning. The second cleaning unit is at least partly movably locatable in the mounting for the first unit. The first unit is attached to the handle through the second unit, and the second unit is integrally formed with the handle. The second cleaning unit is axially movable relative to the first unit, and the second unit is axially located within an axial aperture of the first unit.

The first cleaning unit is sized so as to be able to efficiently clean and/or scrub an inside of a baby bottle. The first cleaning unit is generally cylindrical in shape, and the second cleaning unit is a nipple brush. The nipple brush includes a brush portion sized so as to be able to clean an inside of a nursing nipple. The second cleaning unit is smaller than the first unit and the utensil can be used to clean both baby bottle and nursing nipple.

Each cleaning unit includes a brush with relatively outwardly extending bristles. The first cleaning unit includes at least one sponge which is relatively outwardly extending. The sponge is made up of at least two separate portions, the separate sponge portions being relatively axially displaced. The axis is the longitudinal axis of the utensil, and the bristle portion is located between the two sponge portions.

There is a closable cavity in the handle. The cavity is for containing cleaning fluid, and the cavity is connected with at least one of the first cleaning unit or the second cleaning unit. As such, cleaning fluid can be expelled from the container through at least one of the units to facilitate the cleaning of the bottle.

DRAWINGS

The above-mentioned features and objects of the present disclosure will become more apparent with reference to the following description taken in conjunction with the accompanying drawings, wherein like reference numerals denote like elements, and in which.

DETAILED DESCRIPTION

Figure 1:
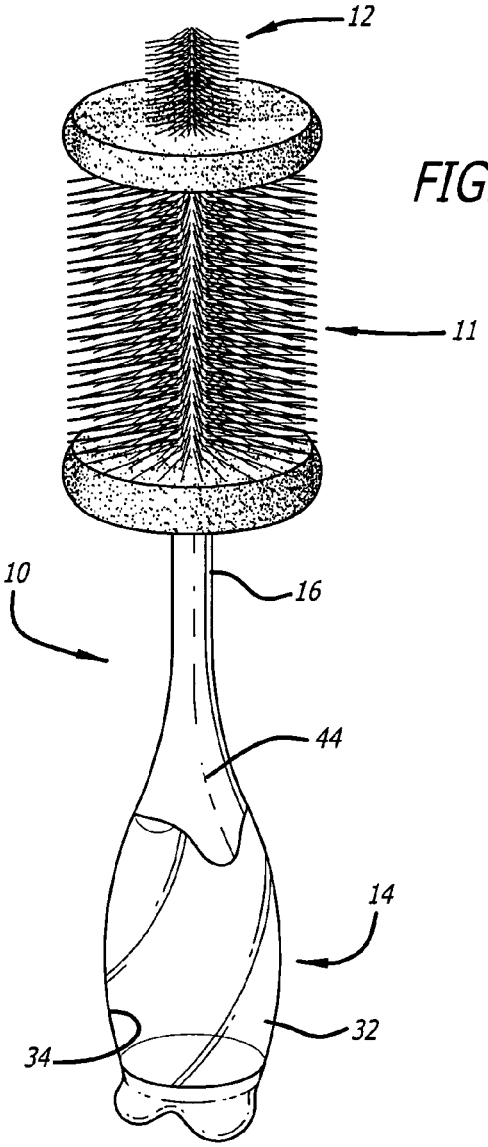
FIG. 1 is a perspective view of the utensil showing the top of the utensil.
Figure 5:
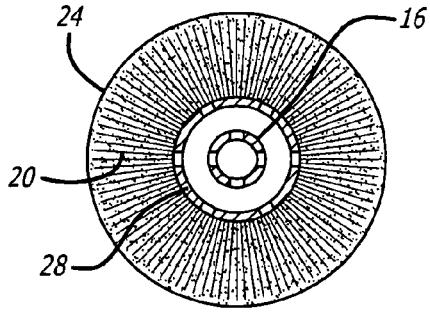
FIG. 5 is a side view showing the second cleaning unit projecting to the maximum beyond the first cleaning unit.

The device is now described with reference to an example which is not to be considered as limiting. This is purely an illustration of the device.

One of ordinary skill in the art will understand that the present discussion is a description of exemplary embodiments only, and is not intended as limiting the broader aspects of the present disclosure, which broader aspects are embodied in the exemplary construction. A repeat use of reference characters in the present specification and drawings represents the same or analogous features or elements of the disclosure.

A cleaning utensil for cleaning a container comprises a larger first cleaning unit sized and configured so as to be able to effectively clean a portion of an inside of a container. There is a second smaller cleaning unit sized and configured differently to the first cleaning unit so as to be able to effectively clean a second portion of an inside of the container.

The first large cleaning unit and second smaller cleaning unit are relatively axially movable with respect to each other and both cleaning units are attached to an elongated handle. The first larger unit is indirectly attached to the handle through the second smaller unit.

The elongated handle is intended for to be gripped by the hand of a user such that the user can manipulate the cleaning units around the inside of the container during cleaning.

The second smaller cleaning unit is at least partly movably locatable in the mounting for the first larger unit. The second cleaning unit fits with the first cleaning unit as an interference fit. The second unit is integrally formed with the handle, and the second unit is located axially within an axial aperture of the first unit.

The second smaller cleaning unit is positioned at least partially in a recess formed in the first unit. A grip portion is provided on the handle to be gripped by a user.

Each cleaning unit includes a brush with relatively outwardly extending bristle portions. The first larger cleaning unit includes two sponges which are relatively outwardly extending. The bristle portion of the first cleaning unit is located between the two sponge portions.

There is a closable cavity in the handle. The cavity is for cleaning fluid, and the cavity is connected with at least one of the first cleaning unit or second cleaning unit. As such, cleaning fluid can be expelled from the cavity container through at least one of the units to facilitate the cleaning of the bottle.

The large first cleaning unit is sized so as to be able to efficiently clean and/or scrub an inside of a baby bottle. The first cleaning unit is generally cylindrical in shape. The second cleaning unit is a nipple brush. The nipple brush includes a brush portion sized so as to be able to clean an inside of a nursing nipple. The utensil can be used to clean both baby a bottle and a nursing nipple.

As such, the first cleaning unit is sized and configured so as to be able to effectively clean a portion of an inside of the bottle. The second cleaning unit is sized and configured differently to the first cleaning unit so as to be able to effectively clean a second portion of an inside of the bottle.

A grip portion is provided on the handle to be grippable by a user, whereby said utensil is for cleaning and/or scrubbing the different sized formations in a baby bottle.

A cleaning unit 10 includes a first cleaning unit generally indicated by numeral 11 configured to be able to clean a portion of an inside of a container. There is the second cleaning unit generally indicated by numeral 12 which is configured differently to be able to effectively claim a second portion of the inside of the container. There is an elongated handle generally indicated by numeral 14 which is integrally attached to the second cleaning unit 12. The first cleaning unit 11 is slidably mounted relative to the second cleaning unit 12 and accordingly rides up and down on the stem 16 which is part of the handle 14 for the cleaning utensil.

The first cleaning unit appears as an essentially cylindrical barrel with a core 18 onto which are mounted bristles 20. To either side of the bristles 20, there is sponge-like disc element 22 and 24 which is axially displaced so that the bristles 20 are axially located between the sponge-like elements 22 and 24.

Figure 2:
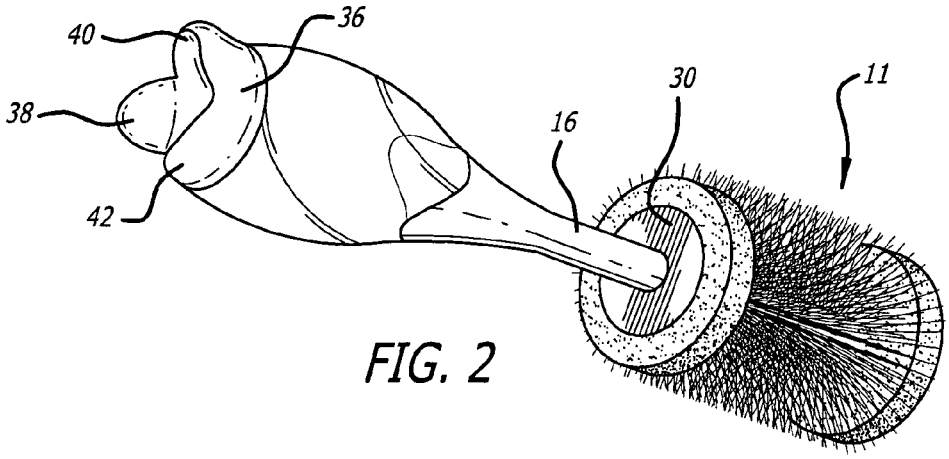
FIG. 2 is a perspective view of the utensil showing the bottom of the utensil.
Figure 3:
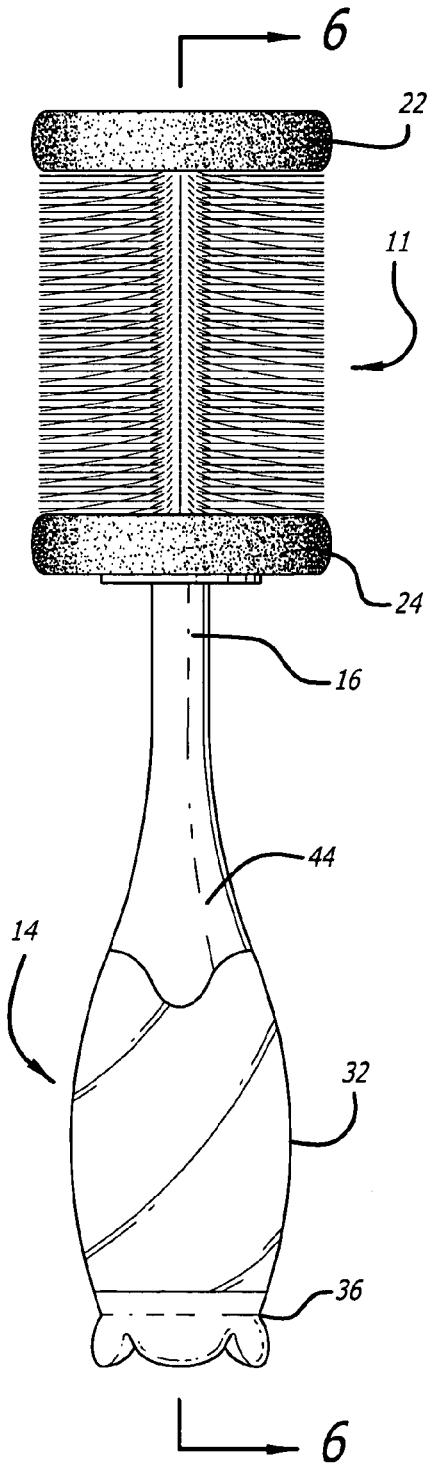
FIG. 3 is a side elevation of the utensil with the second cleaning unit located inside of the first cleaning unit.
Figure 4:
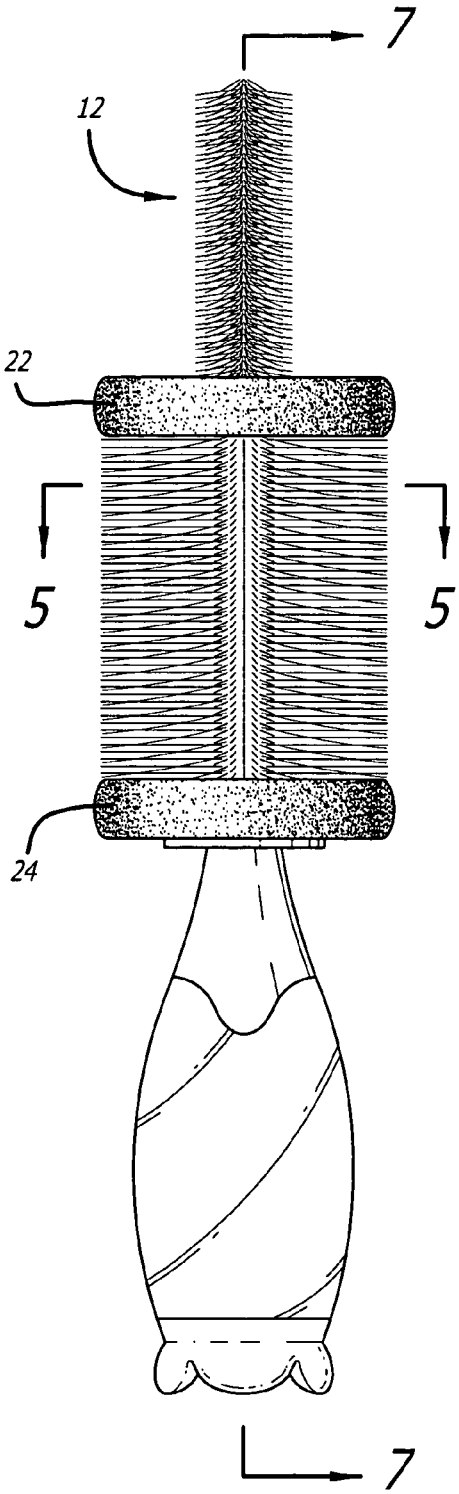
FIG. 4 is a side elevation of the utensil with the first cleaning unit pushed down to expose the second cleaning unit.
Figure 6:
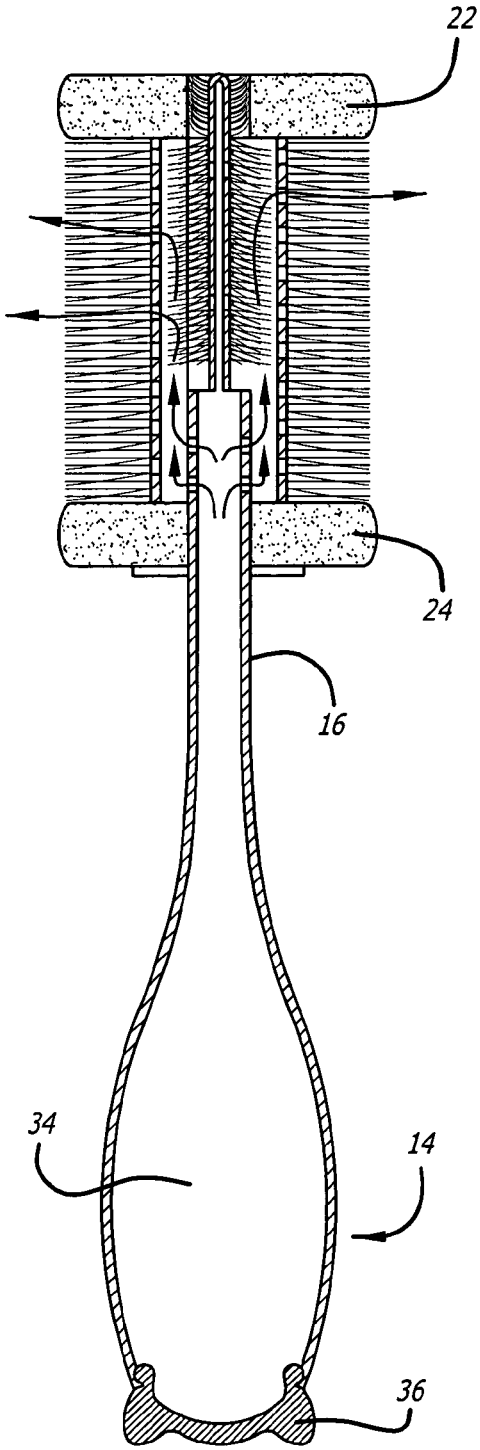
FIG. 6 is a side view showing the first cleaning unit located higher up relative to the second cleaning unit.
Figure 7:
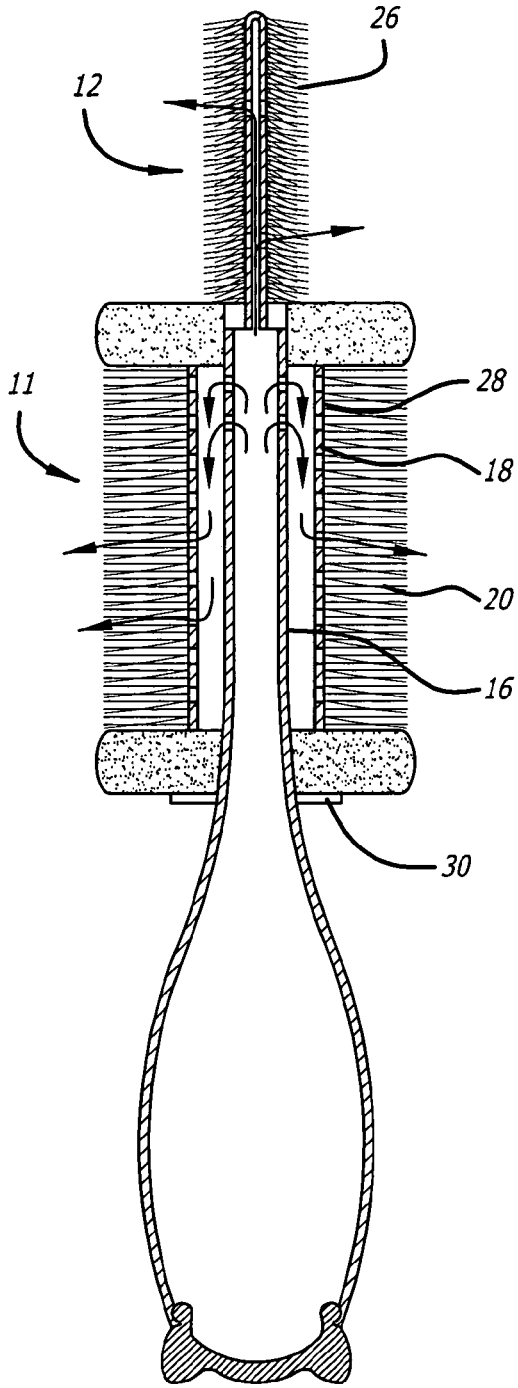
FIG. 7 is a side view of the handle showing the support for the first cleaning unit but without the bristles on the first cleaning unit.

The second unit 12 includes bristles 26 which are mounted on the top of the pedestal 16 and project radially outwardly. The elements 11 and 12 are slidable with an interference fit type configuration. In that regard, the bristles 26 can interact with the inside core of the first cleaning unit 11 and thereby act to provide friction or interference so as to limit unnecessary or undesired movement of the two components relative to each other. Each of the sponge members 22 and 24 are respectively mounted on a base 28 and 30 which can be seen in FIG. 7. The base 30 can also be seen in FIG. 2.

The handle unit 10 can include a transparent portion 32 whereby the inside 34 of a cavity 34 for the handle 14 can be visible. As such, if there is any cleaning fluid in the cavity 34, the fluid can be seen at its particular level. A user can thus know the amount of fluid in the cleaning utensil and whether a refill is necessary.

A cap 36 is provided to the cavity 34. The cap 36 can clip on or screw on to the end of the cavity 34 so that fluid can be added or removed from the cavity as required. The cap includes three feet 38, 40 and 42. In some configurations, these feet with the device can be configured so that the device can stand vertically on the feet in a stable manner. The material 32 or the material 44 which is part of the handle can either or both be relatively flexible. The effect of that can be to cause fluid to be squeezed up a hollow stem for the elongated portion 16 and thus be caused to exit from appropriate apertures on the central core which mounts the second unit 12. The cleaning fluid can exit from that core and enter into the cleaning unit 11 through apertures in the core. This permits the cleaning detergent to effectively be disposed from one or both of the cleaning units 11 or 12 as may be desired. The relative position of the cleaning units 11 and 12 determines the degree of distribution of the cleaning fluid onto either or both of the cleaning units 11 and 12.

The bottle brush can comprise expanded polymeric foam and glass mop materials. The bottle brush head, for either one of or both of the first cleaning unit, can have one or more layers of foam material disposed adjacent a layer of glass mop material.

A single material apparatus can be used to clean a bottle and an artificial nipple. The second cleaning unit, namely a nipple brush head, can be protected while not in use. A nipple brush head can be moved to different orientations relative to a handle, for example, without detaching the nipple brush head from the handle. A bottle brush head can be made of a foam material and a glass mop material.

Such a bottle brush head can clean a bottle better than a standard nylon bristle or foam brush. The nipple brush head and bottle brush head can be permanent or replaceable.

In other embodiments, the bottle brush head may be made from any combination of foam, glass mop, nylon, sponge, soft rubber, or other appropriate bottle cleaning or brush materials. Foam material is a soft, porous material capable of retaining water and other liquids. Glass mop material is a flexible, resilient material, such as a coated felt-type material similar to materials typically used for cleaning flaps in automatic drive-through car washes.

Baby bottles are cleaned using a combination brush by inserting a bottle brush head into a bottle along with soap and water and a moving handle in an up and down or rotating motion until the bottle is clean. Such movement will typically be done with the nipple brush in its stored position. Artificial nipples are cleaned by a combination brush by rotating the nipple brush. Soap and water are applied to the brush and to the nipple. The nipple brush is then used to scrub the surfaces of the nipple, including the inner surface.

The handle is sized and configured to be gripped in one hand of a user, and a reservoir defined within the handle for storing a detergent.

Dispensing detergent from the reservoir is effected when the handle is squeezed.

The brush member has a longitudinal axis that is substantially parallel to said longitudinal axis of the handle member. The brush member has a length along the longitudinal axis of the brush member which is longer than a width of the brush member taken along an axis which is perpendicular to said longitudinal axis of the brush member. A user will be able to dispense detergent and scrub the bottle without putting down the utensil.

The utensil can pertain generally to the field of household cleaning. The utensil can be for cleaning articles such as glasses, plates and infant nursing bottles. The utensil is more effective, efficient and attractive than articles that are presently available for similar purposes.

It is to be understood, however, that even though numerous characteristics and advantages of the present disclosure have been set forth in the foregoing description, together with details of the structure and function of the disclosure, the disclosure is illustrative only, and changes may be made in detail, especially in matters of shape, size and arrangement of parts within the principles of the disclosure to the full extent indicated by the broad general meaning of the terms in which the appended claims are expressed.

While the device and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. A cleaning utensil for cleaning a container comprising:

a first cleaning unit being sized and configured so as to be able to effectively clean a portion of an inside of a container;

a second cleaning unit housed within the first cleaning unit and being sized and configured differently to the first cleaning unit so as to be able to effectively clean a second portion of an inside of the container when the second unit is axially extended through and at least partially out of the first unit; and both cleaning units being attached to an elongated handle, the elongated handle being intended to be gripped by the hand of a user such that the user can manipulate the cleaning units around the inside of the container during cleaning.

2. A cleaning utensil according to claim 1, wherein the second cleaning unit is at least partly movably located in the mounting for the first unit, and the first unit is attached to the handle through the second unit, the second unit being integrally formed with the handle.

3. A cleaning utensil according to claim 2, wherein the second cleaning unit is at least partly axially movable relative to the mounting for the first unit, the second unit being located axially within an axial aperture of the first unit.

4. A cleaning utensil according to claim 3, wherein the first cleaning unit includes a sponge which is relatively outwardly extending, the sponge being in at least two separate portions, the separate sponge portions being relatively axially displaced, the axis being the longitudinal axis of the utensil, and the bristle portion being located between the two sponge portions.

5. A cleaning utensil according to claim 2, wherein the second cleaning unit is positioned at least partly in a recess and a grip portion is provided on the handle to be grippable by a user, whereby said utensil being used for scrubbing the different sized formations in a container.

6. A cleaning utensil according to claim 1, wherein each cleaning unit includes a brush with relatively outwardly extending bristles.

7. A cleaning utensil according to claim 6, wherein the first cleaning unit includes a sponge which is relatively outwardly extending.

8. A cleaning utensil according to claim 1, wherein the first cleaning unit includes a sponge which is relatively outwardly extending.

9. A cleaning utensil for cleaning a container comprising:

a first cleaning unit being sized and configured so as to be able to effectively clean a portion of an inside of a container;

a second cleaning unit being sized and configured differently to the first cleaning unit so as to be able to effectively clean a second portion of an inside of the container; and the first cleaning unit and second cleaning unit being relatively movable with respect to each other and both cleaning units being attached to an elongated handle, the elongated handle being intended to be gripped by the hand of a user such that the user can manipulate the cleaning units around the inside of the container during cleaning, wherein the first cleaning unit includes a sponge which is relatively outwardly extending, the sponge being in at least two separate portions, the separate sponge portions being relatively axially displaced, the axis being the longitudinal axis of the utensil, and the bristle portion being located between the two sponge portions.

10. A utensil according to claim 1, wherein second cleaning unit fits with the first cleaning unit as an interference fit.

11. A utensil according to claim 1, wherein the first unit includes a sponge-like portion and a bristled portion.

12. A utensil according to claim 1, including a closable cavity in the handle for containing cleaning fluid, the cavity being connected with at least one of the first cleaning unit or second cleaning unit such that cleaning fluid can be expelled from the container through at least one of the units to facilitate the cleaning of the container.

13. A utensil according to claim 1, wherein the first cleaning unit is sized so as to be able to efficiently clean an inside of a baby bottle, said first cleaning unit being generally cylindrical in shape, and the second cleaning unit is a nipple brush, the nipple brush including a brush portion sized so as to be able to clean an inside of a nursing nipple, the second cleaning unit being smaller than the first unit and being substantially cylindrical in shape, whereby the utensil can be used to clean both baby bottle and nursing nipple.

14. A cleaning utensil for cleaning an inside of a baby bottle comprising:

a first cleaning unit being sized and configured so as to be able to effectively clean a portion of an inside of the bottle;

a second cleaning unit housed within the first cleaning unit and being sized and configured differently to the first cleaning unit so as to be able to effectively clean a second portion of an inside of the bottle when the second unit is axially extended through and at least partially out of the first unit;

both cleaning units being attached to an elongated handle, the elongated handle being intended to be gripped by the hand of a user such that the user can manipulate the cleaning units around the inside of the container during cleaning; and the first cleaning unit being generally cylindrical in shape, and the second cleaning unit being generally cylindrical in shape and including a brush portion sized relatively smaller than the first unit whereby the utensil can be used to clean the baby bottle.

15. A cleaning utensil according to claim 14, wherein the second cleaning unit is at least partly movably located in the mounting for the first unit, and the first unit is attached to the handle through the second unit, the second unit being integrally formed with the handle.

16. A cleaning utensil according to claim 15, wherein the second cleaning unit is at least partly axially movable relative to the mounting for the first unit, the second unit being located axially within an axial aperture of the first unit.

17. A cleaning utensil according to claim 14, wherein each cleaning unit includes a brush with relatively outwardly extending bristles, and wherein the first cleaning unit includes a sponge which is relatively outwardly extending.

18. A cleaning utensil according to claim 14, wherein the first cleaning unit includes a sponge which is relatively outwardly extending, the sponge being in at least two separate portions, the separate sponge portions being relatively axially displaced, the axis being the longitudinal axis of the utensil, and the bristle portion being located between the two sponge portions.

19. A utensil according to claim 14, including a closable cavity in the handle for containing cleaning fluid, the cavity being connected with at least one of the first cleaning unit or second cleaning unit such that cleaning fluid can be expelled from the container through at least one of the units to facilitate the cleaning of the bottle.

20. A cleaning utensil for cleaning a baby bottle comprising:

a handle having a closable cavity for fluid;

a first cleaning unit being sized and configured so as to be able to effectively clean a portion of an inside of a baby bottle;

a second cleaning unit housed within the first cleaning unit and being sized and configured differently to the first cleaning unit so as to be able to effectively clean a second portion of an inside of the baby bottle when the second unit is axially extended through and at least partially out of the first cleaning unit; and both cleaning units being attached to the handle.

21. A cleaning utensil according to claim 20, wherein the second cleaning unit is at least partly movably located in the mounting for the first unit.

22. A cleaning utensil according to claim 21, wherein the second cleaning unit is at least partly axially movable relative to the mounting for the first unit, the second unit being located axially within an axial aperture of the first unit.

23. A cleaning utensil according to claim 22, wherein the first cleaning unit includes a sponge which is relatively outwardly extending, the sponge being in at least two separate portions, the separate sponge portions being relatively axially displaced, the axis being the longitudinal axis of the utensil, and the bristle portion being located between the two sponge portions.

24. A utensil according to claim 22, wherein second cleaning unit fits with the first cleaning unit as an interference fit.

25. A cleaning utensil according to claim 21, wherein the second cleaning unit is positioned at least partly in a recess and a grip portion is provided on the handle to be grippable by a user, whereby said utensil being for cleaning the different sized formations in a baby bottle.

26. A cleaning utensil according to claim 20, wherein each cleaning unit includes a brush with relatively outwardly extending bristles.

27. A cleaning utensil according to claim 26, wherein the first cleaning unit includes a sponge which is relatively outwardly extending.

28. A cleaning utensil according to claim 20, wherein the first cleaning unit includes a sponge which is relatively outwardly extending.

29. A cleaning utensil for cleaning a baby bottle comprising:

a handle having a closable cavity for fluid;

a first cleaning unit being sized and configured so as to be able to effectively clean a portion of an inside of a baby bottle;

a second cleaning unit being sized and configured differently to the first cleaning unit so as to be able to effectively clean a second portion of an inside of the baby bottle; and the first cleaning unit and second cleaning unit being relatively movable with respect to each other and both cleaning units being attached to the handle, wherein the first cleaning unit includes a sponge which is relatively outwardly extending, the sponge being in at least two separate portions, the separate sponge portions being relatively axially displaced, the axis being the longitudinal axis of the utensil, and the bristle portion being located between the two sponge portions.

30. A utensil according to claim 20, wherein second cleaning unit fits with the first cleaning unit as an interference fit.

31. A utensil according to claim 20, wherein the first cleaning unit includes a sponge-like portion and a bristle portion.

32. A utensil according to claim 31, wherein the bristle portion is substantially cylindrical in shape.

33. A utensil according to claim 20, wherein the closable cavity in the handle is for containing cleaning fluid, the cavity being connected with at least one of the first cleaning unit or second cleaning unit such that cleaning fluid can be expelled from the container through at least one of the units to facilitate the cleaning of the bottle.

34. A utensil according to claim 20, wherein the first cleaning unit is sized so as to be able to clean an inside of a baby bottle, the first cleaning unit being generally cylindrical in shape, and the second cleaning unit being relatively smaller than the first cleaning unit and being substantially cylindrical in shape, whereby the utensil can be used to clean the baby bottle, the bottle having different internal dimensions.

* * * * *